US009439508B2

(12) United States Patent
Wojtowicz et al.

(10) Patent No.: US 9,439,508 B2
(45) **Date of Patent: *Sep. 13, 2016**

(54) OUTSIDE WRAP POST COUPLER WITH ASSEMBLY ASSIST

(75) Inventors: David J. Wojtowicz, Orland Park, IL (US); Thomas St. Germain, Bridgeview, IL (US); Mitchell Liss, Northbrook, IL (US); Al Dunaj, Chicago, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 1455 days.

This patent is subject to a terminal disclaimer.

(21) Appl. No.: 13/184,509

(22) Filed: Jul. 16, 2011

(65) Prior Publication Data

US 2011/0272373 A1 Nov. 10, 2011

Related U.S. Application Data

(63) Continuation-in-part of application No. 11/044,689, filed on Jan. 27, 2005, now Pat. No. 8,585,313.

(51) Int. Cl.
*A47F 5/14* (2006.01)
*A47B 87/02* (2006.01)
*A47B 96/14* (2006.01)

(52) U.S. Cl.
CPC ..... *A47B 87/0215* (2013.01); *A47B 96/1458* (2013.01); *A47F 5/14* (2013.01)

(58) Field of Classification Search
CPC .. E04B 1/2608; E04B 2/7457; E04B 1/2604; E04B 2001/2448; A47B 96/14; A47B 96/1416; A47B 87/0215; A47B 96/1458; A47B 57/402; A47B 57/50; A47B 57/487; A47B 57/22; A47F 5/101; A47F 5/14
USPC ..... 403/109.2, 109.8, 283, 286, 292, 293, 403/295, 300, 305, 353, 393; 211/182, 211/189–192, 194; 52/582.1, 848; 256/47, 256/DIG. 5
See application file for complete search history.

(56) References Cited

U.S. PATENT DOCUMENTS

| | | | | | |
|---|---|---|---|---|---|
| 2,226,763 | A * | 12/1940 | Geib et al. | ..... | 446/116 |
| 3,056,507 | A * | 10/1962 | Squires, Jr. et al. | ..... | 108/106 |
| 4,598,512 | A * | 7/1986 | Chapman | ..... | 52/165 |
| 4,967,916 | A * | 11/1990 | Handler et al. | ..... | 211/187 |
| 5,971,175 | A * | 10/1999 | Bustos | ..... | 211/187 |
| 6,209,155 | B1 * | 4/2001 | Epstein et al. | ..... | 5/201 |
| 6,397,413 | B2 * | 6/2002 | Epstein et al. | ..... | 5/201 |
| 6,839,920 | B2 * | 1/2005 | Schulte | ..... | 5/200.1 |

* cited by examiner

*Primary Examiner* — Gregory Binda
*Assistant Examiner* — Nahid Amiri
(74) *Attorney, Agent, or Firm* — Wood, Herron & Evans, LLP

(57) ABSTRACT

A post coupler includes coupler flanges, reverse bend flanges extending therealong and rounded end projections extending longitudinally from said coupler flanges defining ends of the coupler, the length of the reverse bend flanges being less than the overall coupler length between ends of the rounded end projections.

5 Claims, 14 Drawing Sheets

OUTSIDE WRAP POST COUPLER WITH ASSEMBLY ASSIST

PRIORITY CLAIM

This application is a Continuation-in-Part of U.S. patent application Ser. No. 11/044,689 filed Jan. 27, 2005, published under Publication No. US2006/0163438, entitled "POST COUPLER", both of which are expressly incorporated herein by reference in their entirety.

RELATED PATENT APPLICATIONS

This application is related to co-pending applications filed on even date herewith and including:

- U.S. application Ser. No. 29/397,486 entitled "DESIGN FOR WRAPPED POST COUPLER";
- U.S. application Ser. No. 29/397,490 entitled "DESIGN FOR POST COUPLER WITH SCALLOPED EDGES";
- U.S. application Ser. No. 29/397,488 entitled "DESIGN FOR POST COUPLER WITH KEYHOLE OPENING";
- U.S. application Ser. No. 13/184,506 entitled "OUTSIDE WRAP POST COUPLER ACCOMMODATING BEAM RIVET";
- U.S. application Ser. No. 29/397,487 entitled "DESIGN FOR POST COUPLER WITH INSIDE WRAP";
- U.S. application Ser. No. 29/397,485 entitled "DESIGN FOR POST COUPLER WITH SCALLOPED EDGES AND INSIDE WRAP";
- U.S. application Ser. No. 29/397,489 entitled "DESIGN FOR POST COUPLER WITH KEYHOLES AND INSIDE WRAP";
- U.S. application Ser. No. 13/184,507 entitled "INSIDE WRAP POST COUPLER ACCOMMODATING BEAM RIVET";
- U.S. application Ser. No. 13/184,511 entitled "INSIDE WRAP POST COUPLER WITH ASSEMBLY ASSIST"; and
- U.S. application Ser. No. 29/397,491 entitled "DESIGN FOR INNER POST COUPLER".

All these related applications are herewith expressly incorporated herein by reference as if fully set out herein.

FIELD OF THE INVENTION

This invention relates to shelving and to post couplers used in coupling shelf supporting columns end-to-end in a shelving unit and facilitating assembly of the coupler to post sections for forming a unitary corner post useful in the shelving unit.

BACKGROUND OF THE INVENTION

Prior post couplers have been used to couple post ends together to form an elongated, unitary corner post or column used with other corner posts to support a plurality of shelves mounted on elongated brackets or beams connected to and extending horizontally between the corner posts. Typically, the posts are of angled construction defined by flanges at 90° to each other and are provided with keyhole-shaped slots for receiving rivets extending from the elongated shelf beams which are oriented horizontally between the posts. The rivets interlock the beams to the posts to define a ladder-like shelf frame on which shelves are supported. These beams can thus be adjusted vertically, up and down the posts, to provide for a desired vertical spacing between shelf members supported by the beams.

Such couplers are shown, for example, in co-pending U.S. patent application Ser. No. 11/044,689, filed Jan. 27, 2005, published under Publication No. US2006/0163438, which are incorporated herein by reference in their entirety.

It will be appreciated that such prior couplers have, and present, upper and lower ends terminating in edges which are relatively flat or straight. Post sections, and particularly ends thereof have relatively flat or straight linear edges, these ends being inserted into the gaps defined by flanges of the couplers for securing the sections end-to-end in abutting relation.

Accordingly, in assembly of a coupler to two post sections, the section ends are inserted into the coupler into gaps formed by respective flanges of the coupler. The flanges define slot-shaped openings into the gaps. If the post section being inserted into the slot, and gap, is not well-aligned with the longitudinal orientation of the coupler which wraps around the post section from the outside thereof, the straight post edge can engage a straight flange edge defining the slot or gap opening, preventing or rendering difficult the telescoping of the coupler onto the post section. The straight edges of the two components engage and obstruct slipping the post ends into the gaps of the coupler. Similar assembly difficulties are encountered if the flanges of the post sections and the flanges of the coupler are not formed with precisely similar included angles therebetween.

Accordingly, it is one objective of the invention to provide a post coupler which facilitates the assembly together of the coupler and a post section where the coupler wraps around the post section from the outside.

A further objective of the invention has been to provide a post coupler facilitating the assembly of two post components thereto and from two respective opposed ends of the coupler, where the coupler wraps around the post components from the outside.

A further objective of the invention has been to provide an easily assembled shelving unit wherein the structure of a post coupler for coupling respective ends of post sections forming a corner post in the shelving unit guides the post section ends into the coupler without undue interference between end edges of the coupler and the post section ends, and where the coupler wraps around the post section from the outside.

SUMMARY OF THE INVENTION

To these ends, a coupler according to the invention includes a pronounced, fully and continuously rounded projection extending from each respective end thereof and from each coupler flange of the coupler. The surface of these projections flows into the coupler flanges and the post-receiving slot formed by these and reverse bend flanges of the coupler.

Accordingly, the flat post-section end edges do not have to be in exact alignment with the slot, formed by coupler flanges, to receive the post section ends. Instead, a corner of the post section, where the post flanges meet, is moved relatively onto the coupler projection and the projection surfaces guide the post end into the coupler gaps confining and progressively aligning the post and coupler.

Stated in another way, as the post section end and the coupler progressively approach, any initial contact is between a curved edge of the coupler projection with the flat end edges of the post section, smoothing and guiding the progressive contact and reducing any flat-edge to flat-edge contact.

Assembly of coupler to post sections is thus facilitated and enhanced.

Assembly of a shelving unit formed of such post coupler and post sections is facilitated. Moreover, since the projections of the coupler reach out longitudinally along the corner of the post sections between their flanges, greater stability between the coupled post sections is provided, resulting in an enhanced and rigid shelving unit.

Finally, it will be appreciated the ends of the respective coupler projections define the longitudinal extent of the entire coupler. The reverse bend flanges extend along the direction of the coupler's longitudinal extension but are shorter than the overall coupler length and terminate short of the projections, thus not interfering with initial post section movement toward final seating within the coupler.

These and other features and advantages of the invention will be further readily understood from the following written description and from the drawings in which:

BRIEF DESCRIPTION OF THE DRAWINGS

FIG. 9 is an isometric view similar to FIG. 2 but showing an alternate embodiment with beams mounted on the outside of the coupler;

FIG. 10 is a plan top view taken along lines 10-10 of FIG. 9;

FIG. 11 is a cross-sectional view similar to FIG. 4 but is taken along lines 11-11 of FIG. 9;

FIG. 12 is an elevational view in partial cross-section taken along lines 12-12 of FIG. 10;

FIG. 13 is an enlarged view of the encircled area 13 of FIG. 12;

FIG. 14 is a cross-sectional view taken along lines 14-14 of FIG. 10; and FIG. 15 is an enlarged view of the encircled area 15 of FIG. 14.

DETAILED DESCRIPTION OF THE INVENTION

Figure 1:
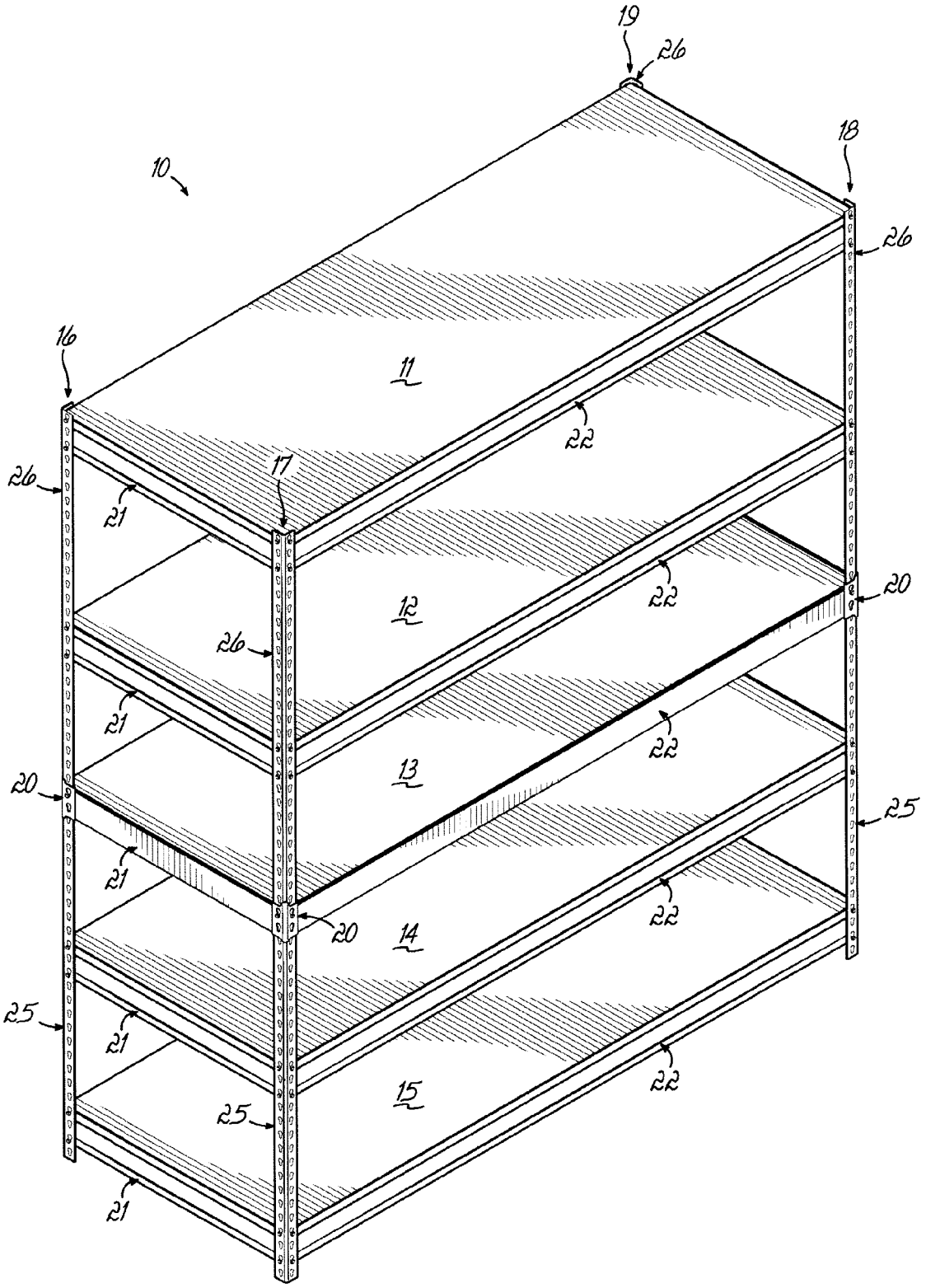
FIG. 1 is an isometric view of a shelving unit according to the invention.

For purposes of this application, the terms "inner", "inside" or "interior" refer to post or coupler from within a shelving unit. The terms "outer", "outside" or "exterior" refer to post or coupler as viewed from without a shelving unit.

The coupler 20 best seen in FIG. 2A comprises two major integral coupler flanges 50, 51 disposed at an included angle (at bend 56) to each other at preferably 90°, preferably similar to angle A between the post flanges 34, 35 as will be described.

Each major flange has a reverse bend or fold 52, 53 and an inwardly directed reverse bend flange 54, 55 respectively turned inwardly, each flange 54, 55 lying parallel to the respective flanges 50, 51 from which they extend.

A gap G is defined by the respectively adjacent flanges 50, 54 and 51, 55 respectively, this gap being approximately equal to the thickness of post flanges 34, 35 respectively.

At each end of the bend 56, the coupler 20 includes a longitudinally protruding and continuously rounded projection 58, 59 projecting outwardly from the ends of flanges 50, 51 at bend 56. Each projection 58, 59 is an extension of flanges 50, 51 and is preferably fully rounded without flat or linear edges. The ends or outer edges of opposite projections 58, 59 define the longitudinal extent and length of the coupler 20. It will be appreciated the reverse bend flanges 54, 55 extend along the coupler 20 between the ends defined by the projections 58, 59 but are shorter in longitudinal length than the overall coupler length.

Figure 2:
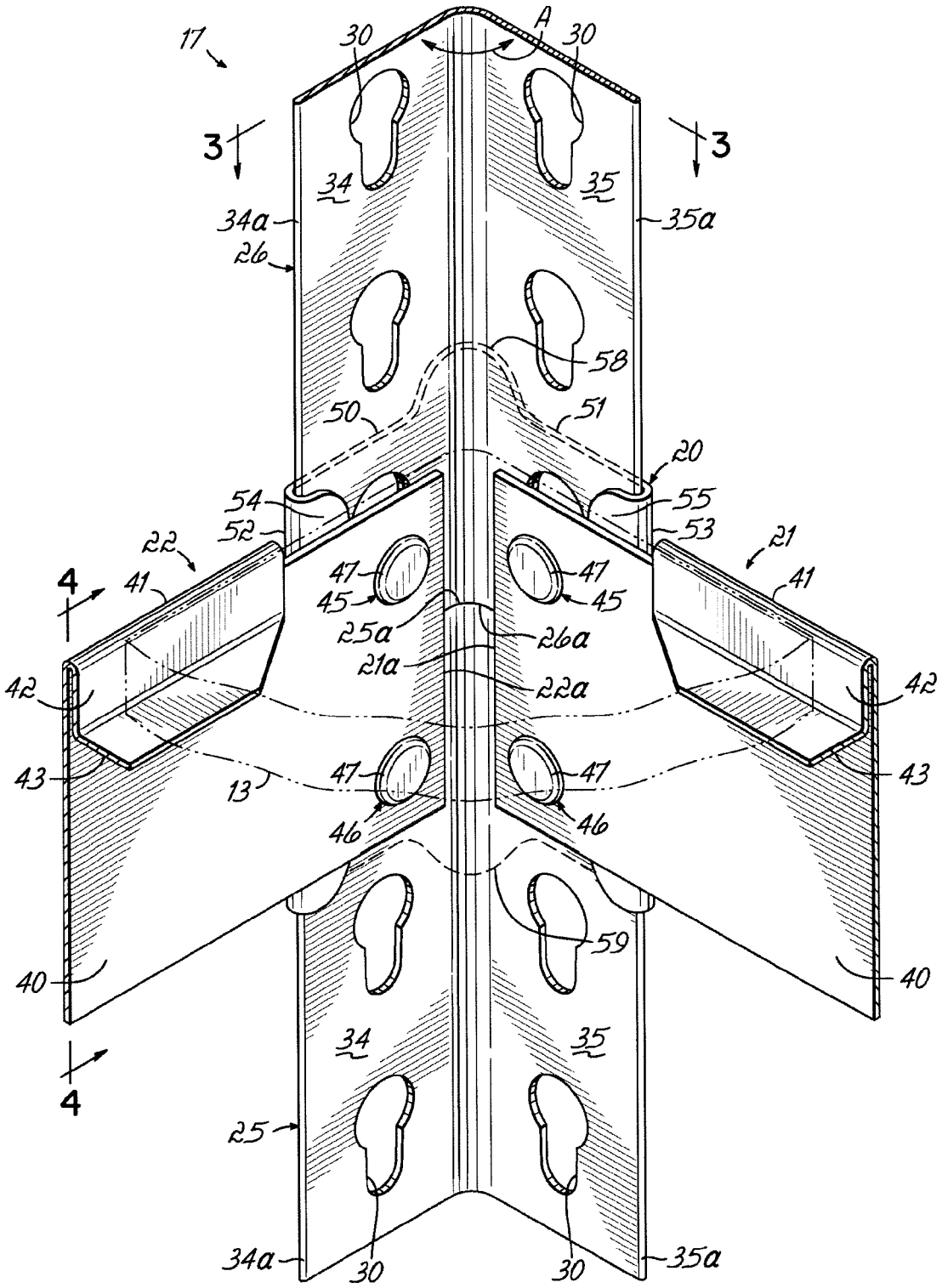
FIG. 2 is an enlarged isometric view of a portion 2 of FIG. 1 from the interior area of the shelving unit and at the juncture of beam, post and coupler.
Figure 2A:
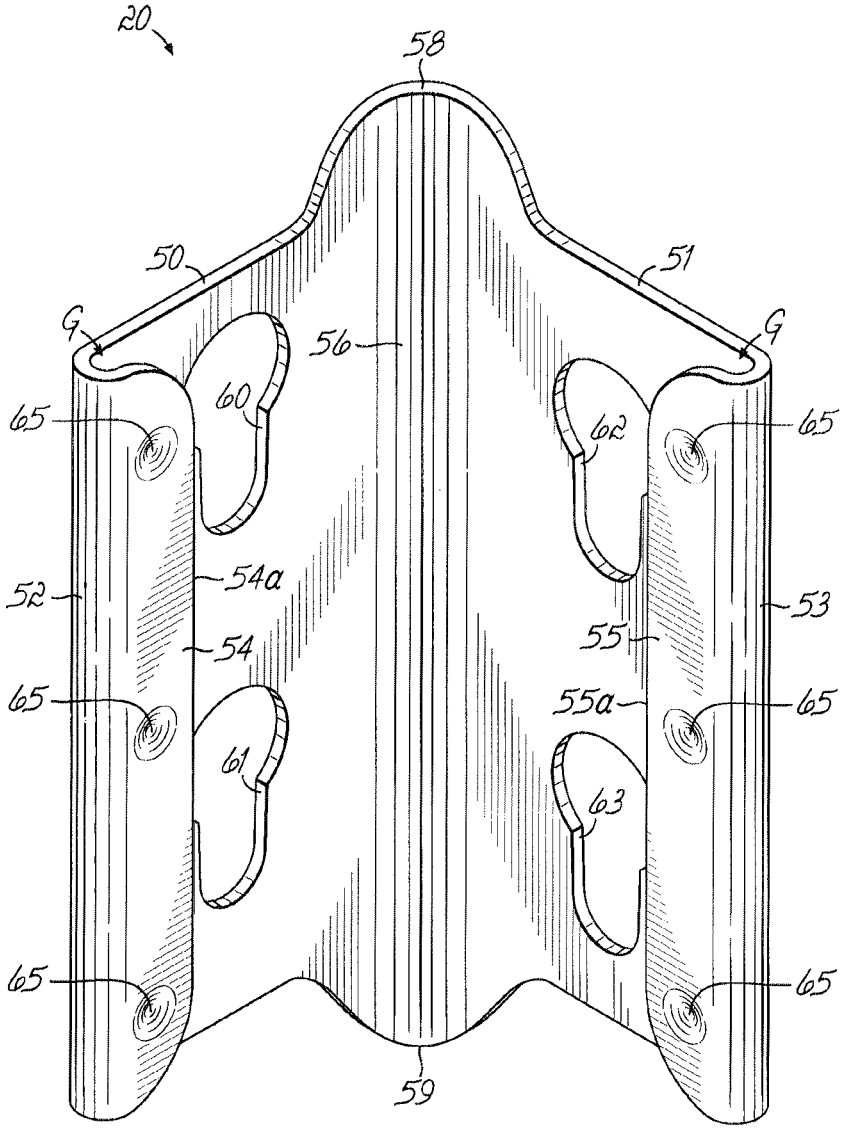
FIG. 2A is an isometric view of the post coupler of the invention.

Coupler 20 also includes a plurality of keyhole-shaped apertures 60-63 as shown in FIG. 2A, one above the other respectively, so apertures 60, 62 are respectively above apertures 61, 63 at the same distance or pitch as separate apertures 30 in the post end sections 25*a*, 26*a*, to be described. Apertures 60-63 are preferably in the same shape as apertures 30 in the post sections 25, 26.

Coupler 20 is also provided with a plurality of detents or projections 65 in the respective reverse bend flanges 54, 55. These extend inwardly into the respective gaps G, and serve to frictionally engage post end sections 25*a*, 26*a* in gaps G when the post end sections are inserted into the coupler 20, as will be described.

In this regard, it will be appreciated the continuously rounded projections 58, 59 serve to aid in the introduction of respective post end sections into the coupler. Thus, projections 58, 59 serve to help guide and facilitate the introduction of the post sections into coupler 20.

Finally, note the reverse bend flanges 54, 55 have respective edges 54*a*, 55*a*. These define the inward extent of flanges 54, 55 so the flanges do not extend over and block apertures 60-63. The reverse bend flanges thus do not subtend apertures 60-63, as would block them for passage of rivets as will be discussed.

Turning now to FIGS. 1-8, one embodiment of the invention comprises a shelf unit 10 having a plurality of shelves 11-15. Four composite corner posts or columns 16-19 define the corners of unit 10, each comprising at least two post sections (could be more) joined by a coupler as at 20 (three appear in FIG. 1 for posts 16, 17 and 18, respectively). Each shelf 11-15 is supported by four horizontally-oriented shelf-supporting brackets or beams as at side beams 21, and front and rear beams 22, with front and rear beams 22 being longer than side beams 21. The rear beam and offside beams not shown in FIG. 1 are respectively identical to the front (22) and side (21) beams as shown in FIG. 1. Side beams 21 on one hand and the front/rear beams 22 on the other hand differ essentially only in length and are otherwise identical.

With attention to FIG. 2, there is shown from the perspective of the interior of the unit 10 a representative corner structure as at post 17, comprised of lower post section 25 and upper post section 26, coupled in end-to-end abutting relationship via coupling or coupler 20 to form a unitary post. The posts, post sections, coupling 20, and the end structure of the beams at each corner of unit 10 are essentially identical, so only one corner structure, coupler, post section and beam intersection as in FIG. 2 will be described.

Figure 3:
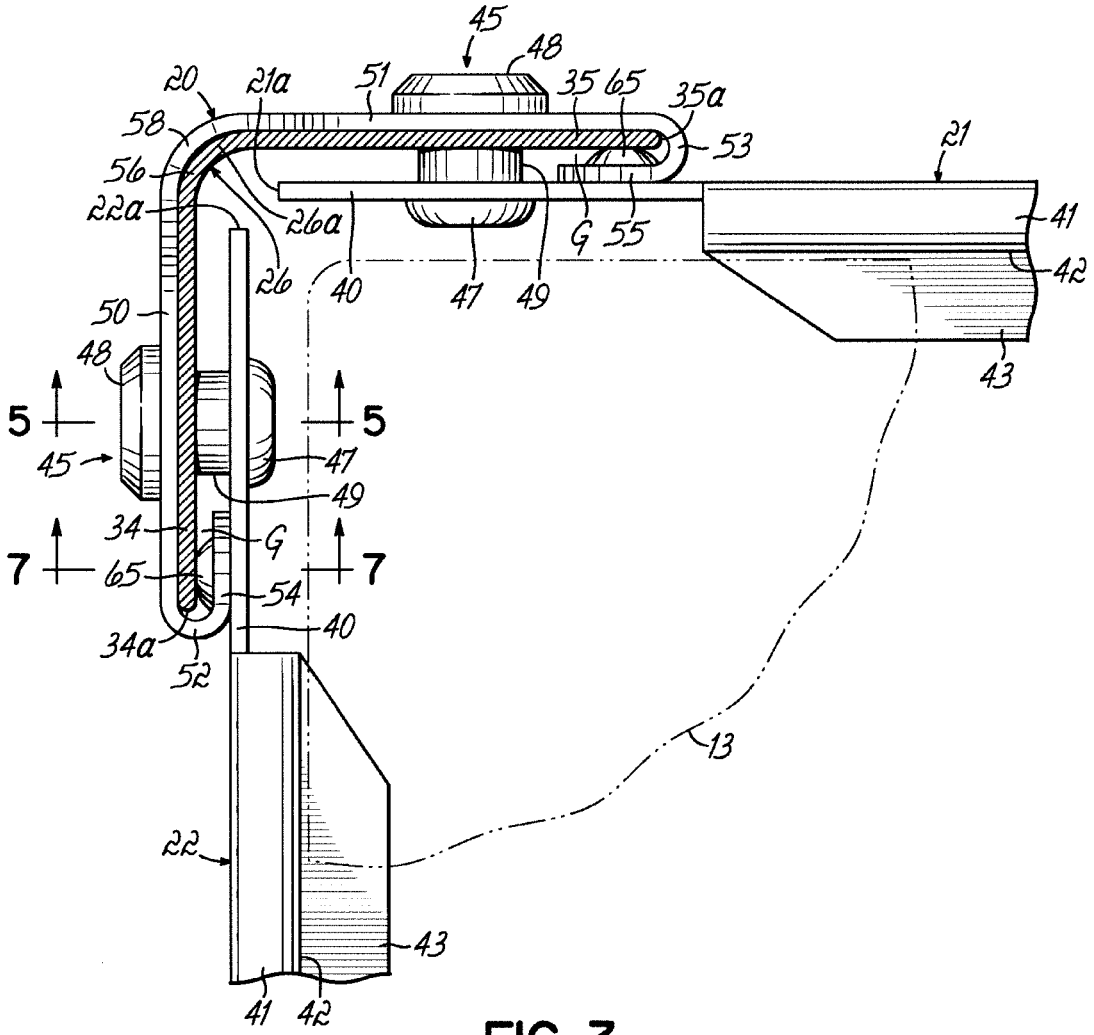
FIG. 3 is a plan view in partial cross-section taken along lines 3-3 of FIG. 2 with an offside portion of the coupler broken away with the beams mounted inside the post and the coupler.
Figure 4:
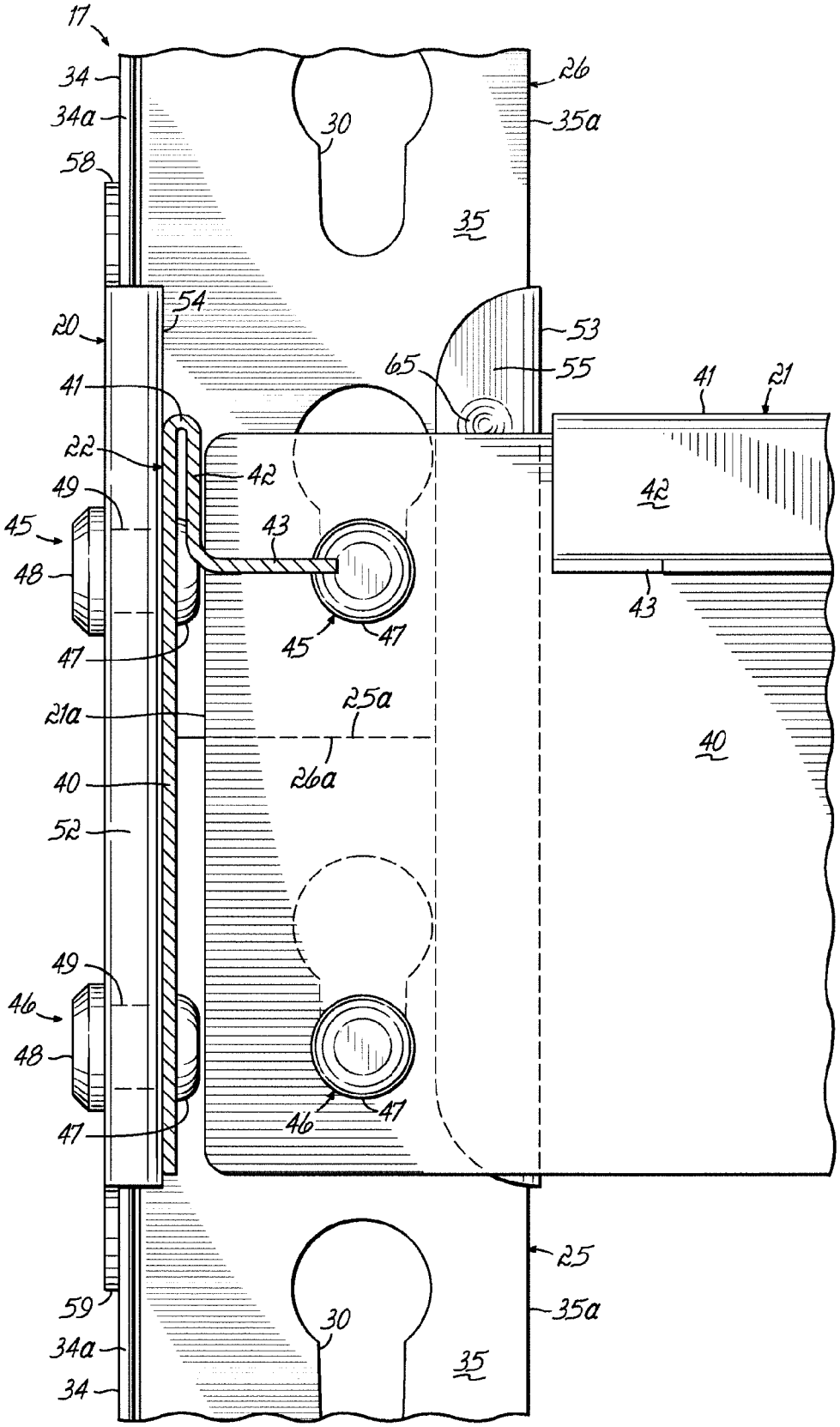
FIG. 4 is an elevational view in partial cross-section of the coupler, posts and beams taken along lines 4-4 of FIG. 2.

For clarity, a self such as shelf 13 is shown in phantom lines only in FIGS. 2 and 3.

Each lower and upper post section 25, 26 is provided with a series of keyhole-shaped apertures 30 as shown, each preferably identically spaced in each post section, one from the other. Preferably, the endmost aperture 30 in each post section 25, 26 is spaced from the section ends at one-half pitch so that when sections 25, 26 are abutted, the two endmost apertures 30 are spaced from each other at the same pitch as each aperture 30 is spaced from other apertures 30 in the same post section. Apertures 30 have enlarged and narrower portions as shown.

Each post section 25, 26 is preferably in the form of an angle, formed by two post flanges 34, 35 at a preferred included angle A of about 90° with respect to each other. Each post flange has an elongated edge 34*a*, 35*a* as shown.

Post sections 25, 26 preferably abut each other end-to-end at section ends 25*a*, 26*a*.

As noted, beams 21, 22 are generally identical except for length in this embodiment; the length of such beams being variable to accommodate the width and depth of a desired shelving unit 10. Beams 21, 22 each incorporate a beam web 40, an upper reverse bend at 41, a flange 42 bent to reside alongside an upper margin of web 40, and a 90° bend defining a shelf-supporting flange 43, all as clearly shown in FIGS. 2-5 and 7.

As perhaps best seen in FIG. 3, flanges 42, 43 are terminated short of ends 21*a* and 22*a* of webs 40. Shelf-supporting flanges 43 are relieved or tapered at an angle, as shown in plan view in FIG. 3, in a direction away from ends 21*a*, 22*a*, so as not to interfere with any proximate beam end.

Figure 5:
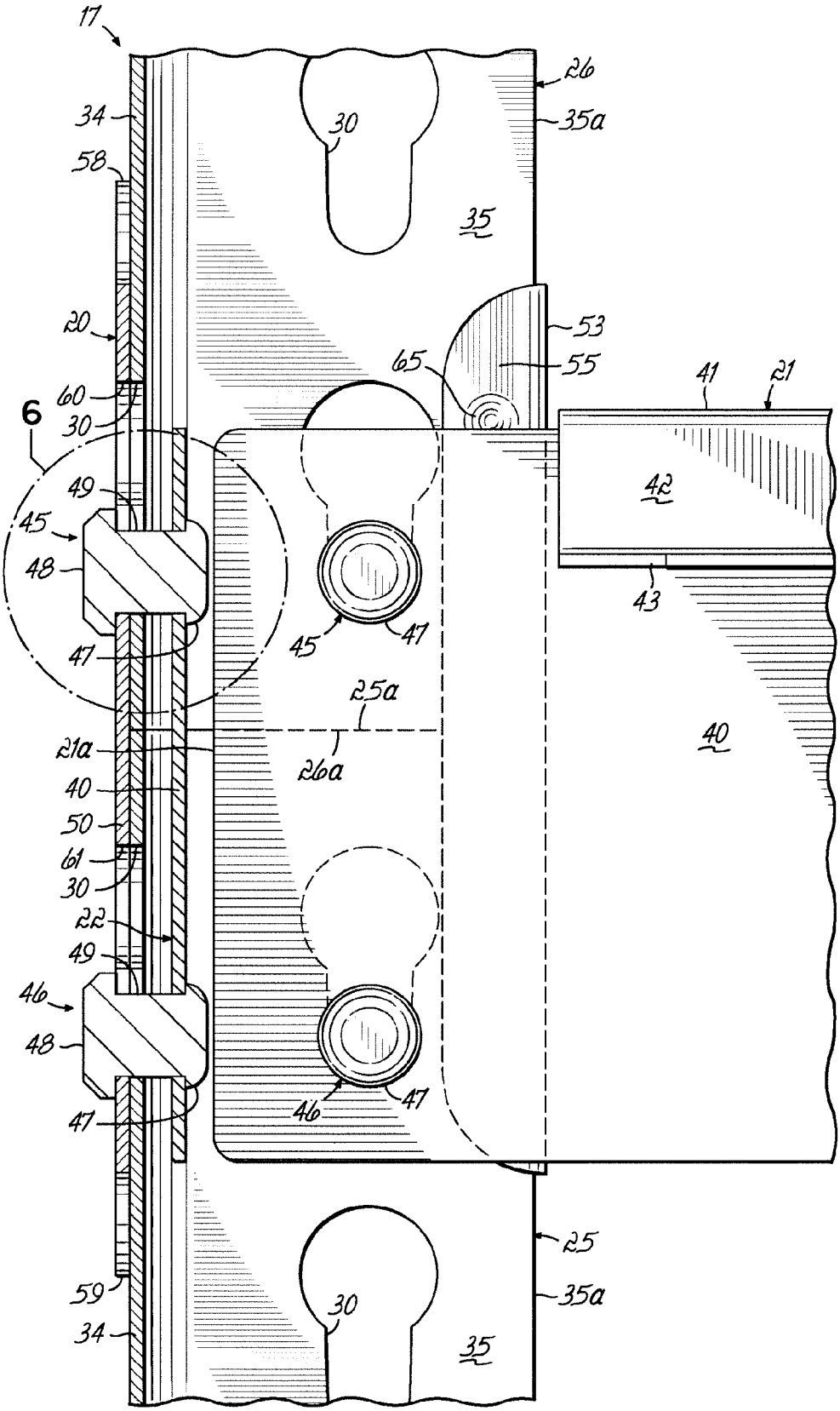
FIG. 5 is a cross-sectional view taken along lines 5-5 of FIG. 3.
Figure 6:
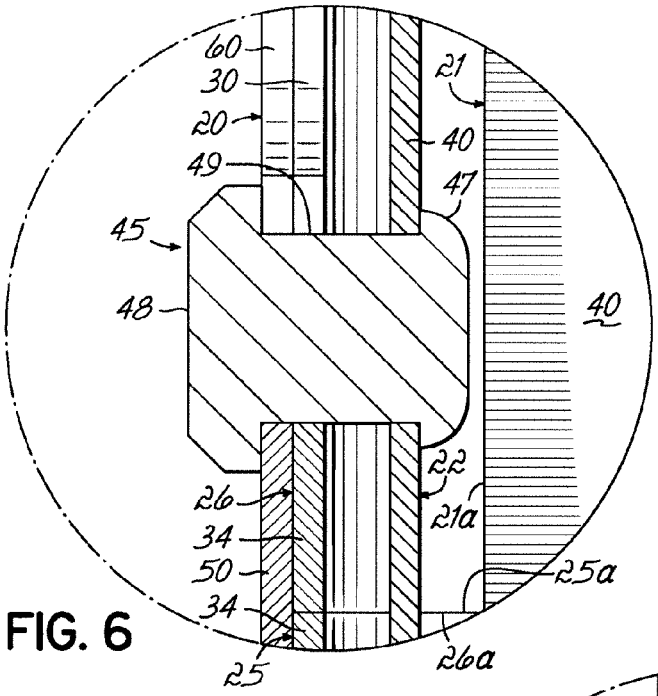
FIG. 6 is an enlarged view of the encircled area 6 of FIG. 5.
Figure 8:
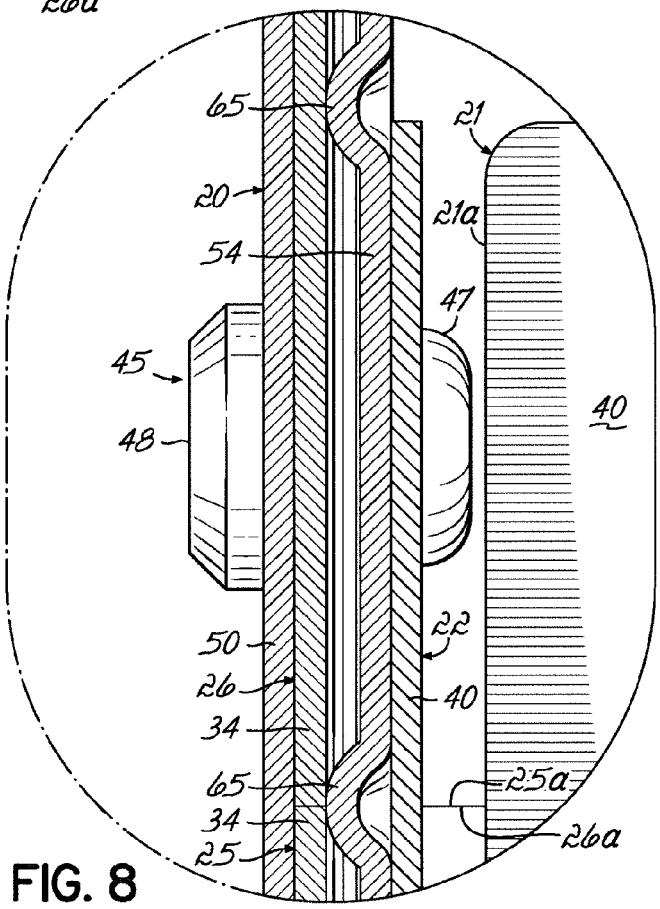
FIG. 8 is an enlarged view of the encircled area 8 of FIG. 7.
Figure 7:
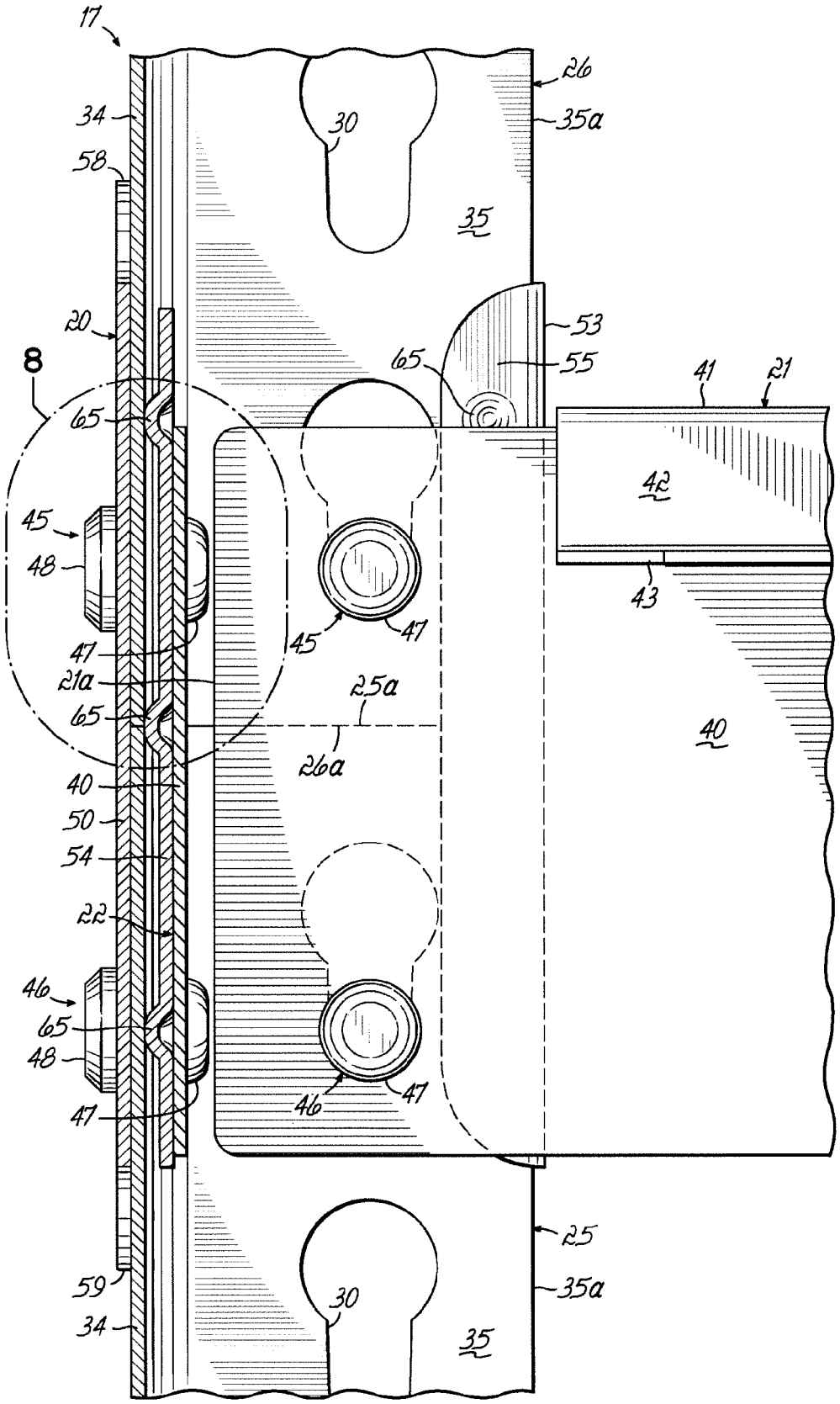
FIG. 7 is a cross-sectional view taken along lines 7-7 of FIG. 3.
Figure 9:
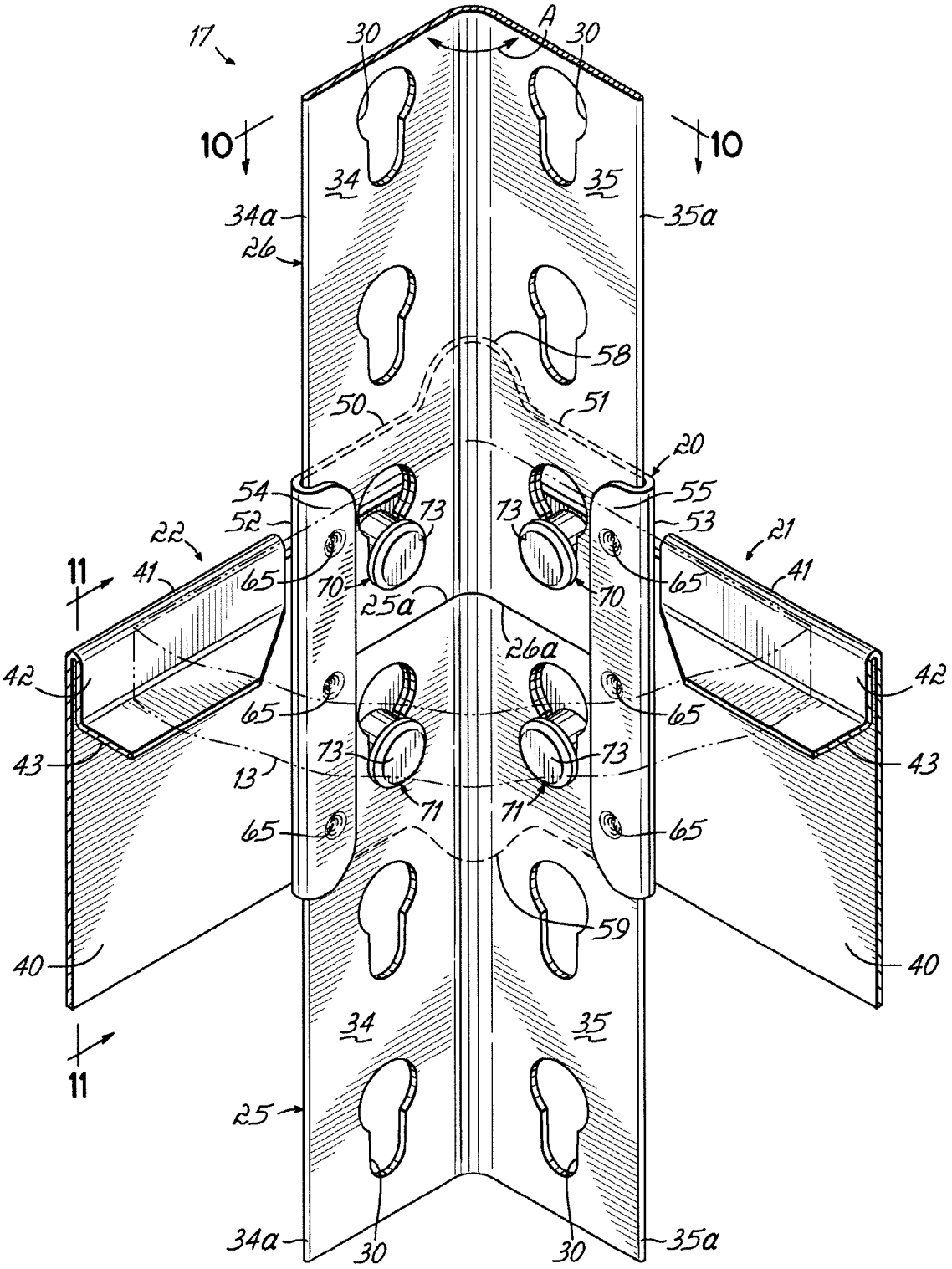
FIGS. 9-15 are similar to FIGS. 2-8 but show an alternate position of the shelf-supporting beams.

Each beam 21, 22 is provided proximate its ends 21*a*, 22*a*, with two beam supporting lugs or rivets 45, 46 (FIG. 4), one above the other. The cross-sectional views of FIGS. 5-6 illustrate one suitable shape of the rivets 45, 46.

Rivets 45, 46 extend through coupling 20 and through respective holes 30 in the post end sections 25*a*, 26*a* described above, and as will be described.

Turning now to the relationship of the components as coupled and connected in an erected shelving unit, FIGS. 2-8 reflect such a unit where the beams 21, 22 are disposed on the inside of post sections 25, 26 (and posts 16-19). FIGS. 9-15 reflect another embodiment wherein beams 21, 22 reside outside post sections 25, 26 and posts 16-19. Both embodiments include a coupler 20 as described herein.

It will be appreciated the embodiments shown in FIGS. 9-15 above are identical to those of FIGS. 2-8 and 15, excepting for the relative dispositions, and excepting the length of the respective rivets 45, 46 in FIGS. 2-8 and shorter rivets 75, 76 in FIGS. 9-15.

In FIGS. 2-8, beams 21, 22 are located inside of posts 16-19. Coupler 20 is disposed substantially outside the posts. FIG. 2 broadly illustrates this embodiment while remaining FIGS. 3-8 show its details.

Referring to FIG. 3, coupler 20 is disposed proximate the bottom end 26*a* of upper post section 26, coupler 20 in secure contact with post section 26. Detents 65 frictionally engage and hold post section 26*a* in gap G, it being appreciated there is some flexibility in flanges 54, 55. Webs 40 of beams 21, 22 lie against reverse bend flanges 55, 54 respectively.

Rivets 45 (FIG. 3) and 46 (FIG. 4) extend through webs 40, post section 25, 26 and coupler 20. Interior rivet heads 47 seat on webs 40. Exterior rivet heads 48 are positioned to pass through the enlarged portions of the post section 25 and coupler 20, allowing shanks 49 to seat in the narrower sections of apertures 30, and 60, 62, securing the components together. Exterior rivet heads 48 rest against those portions of post section 26 surrounding the narrow portions of apertures 60, 62.

The same is true of lower rivets 46 respecting apertures 30 in lower post section 25 and coupler apertures 61, 63. It will here be appreciated that since edges 54*a*, 55*a* of coupler 20 do not block apertures 60-63 in coupler 20, and the rivet heads 48 may pass therethrough in the enlarged portions of the apertures to facilitate erection of shelving unit 10.

Turning now to FIGS. 9-15, beams 21, 22 are disposed on the outside of coupler 20 and of posts 16-19 as shown. Components of this embodiment numbered as the same components of FIGS. 2-8 are the same except for relative disposition.

Figure 10:
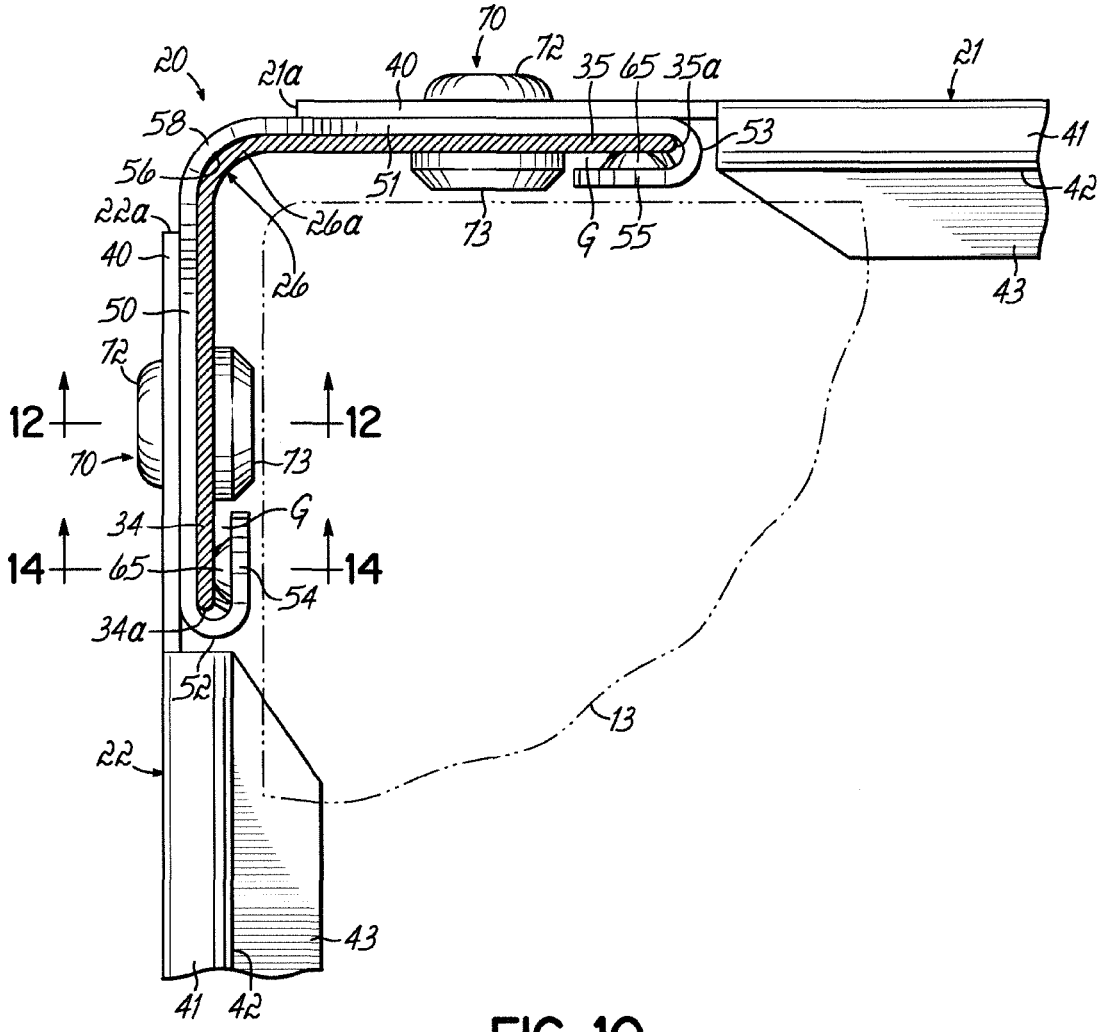
Figure 11:
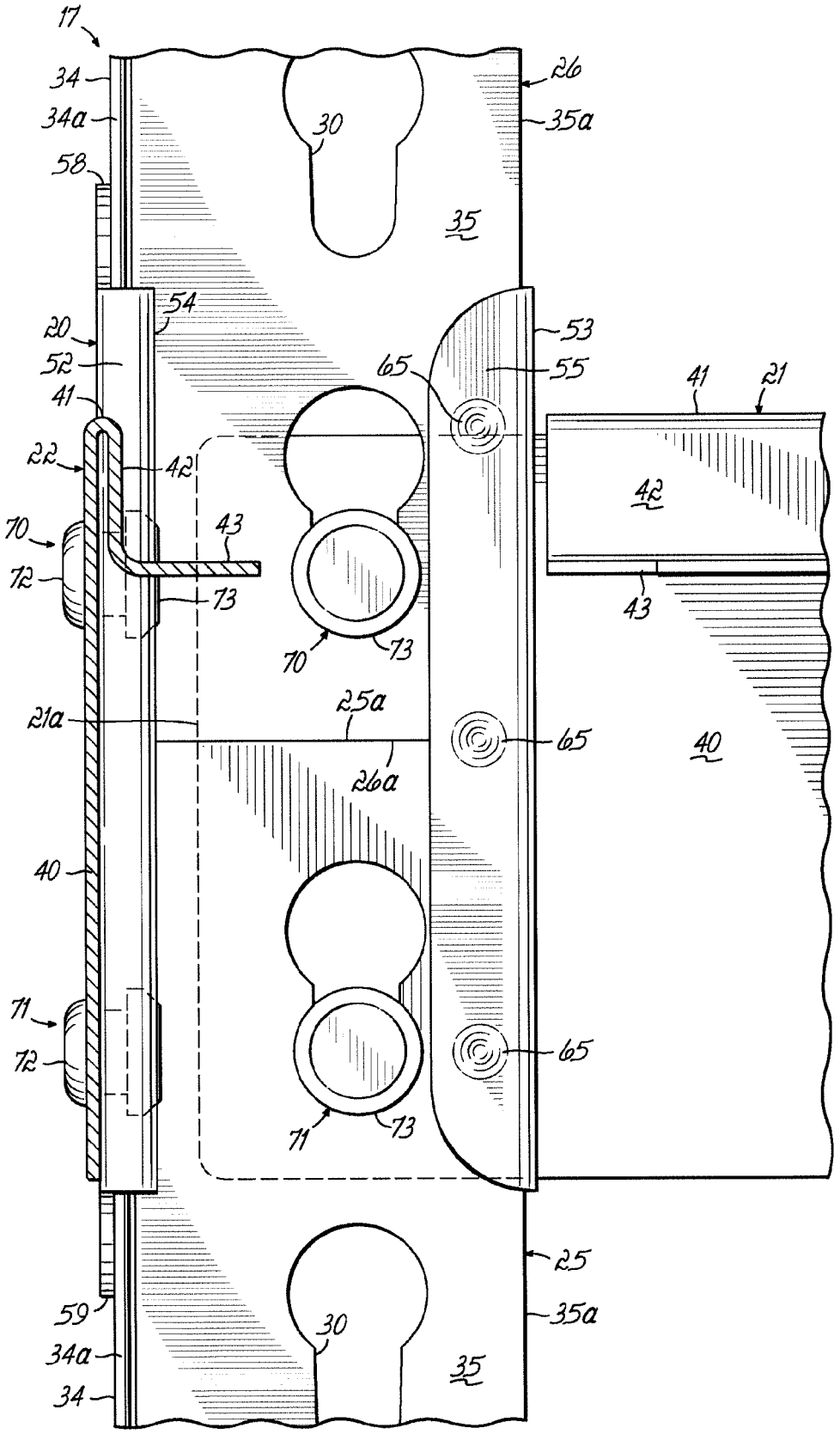
Figure 12:
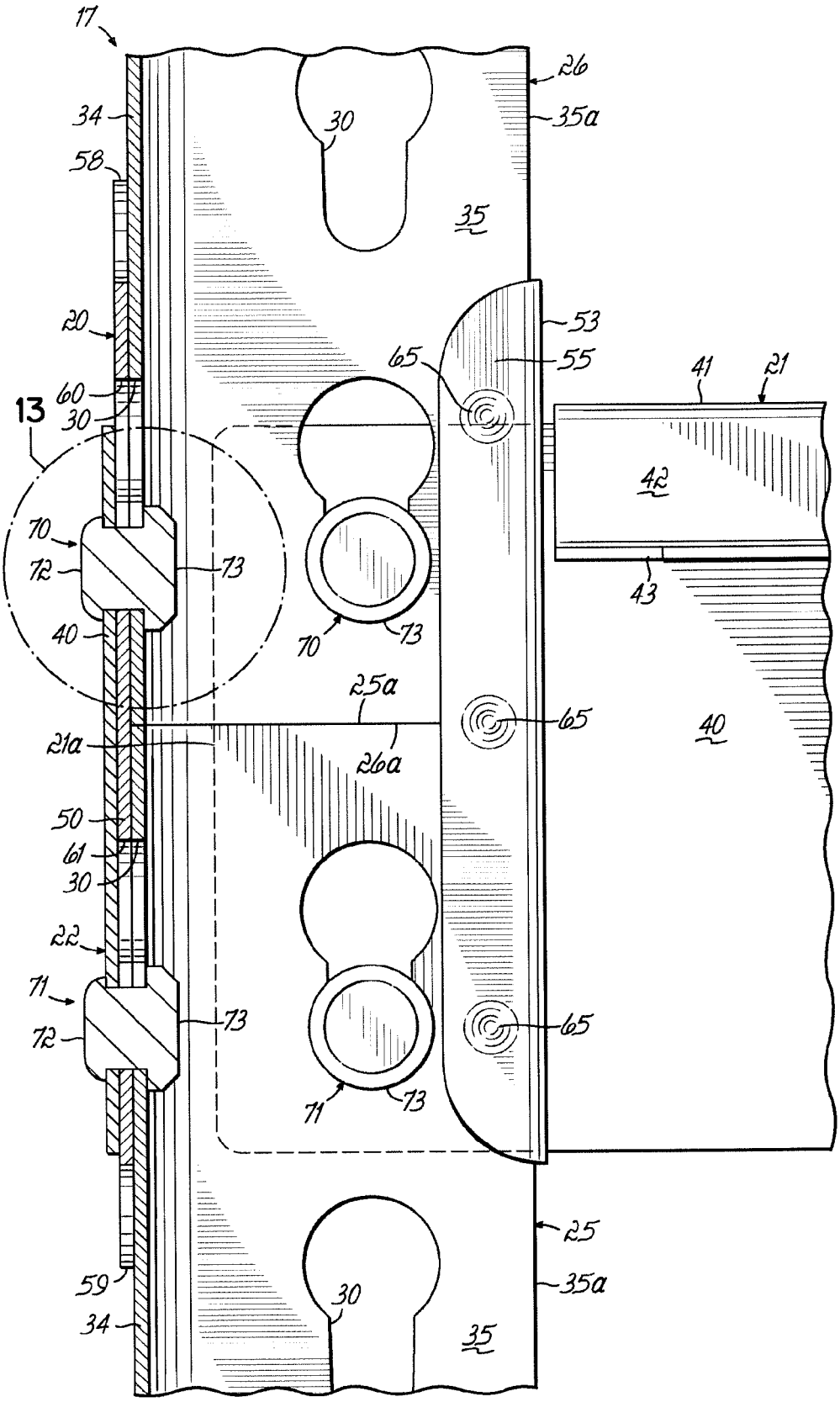
Figure 13:
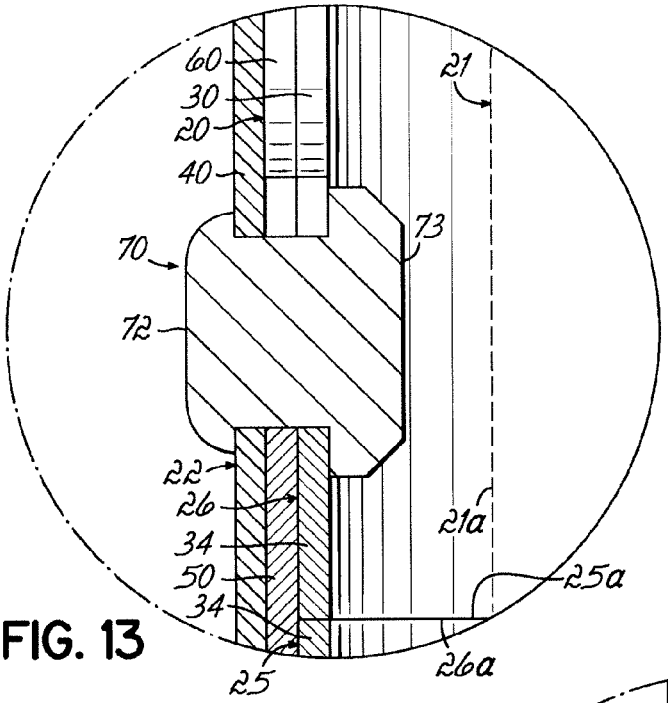
Figure 15:
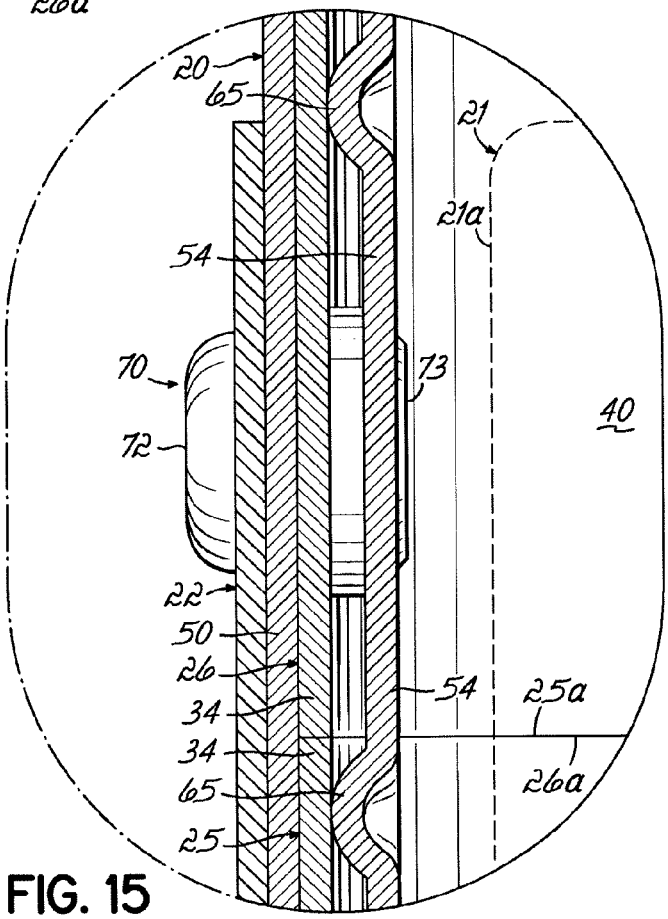
Figure 14:
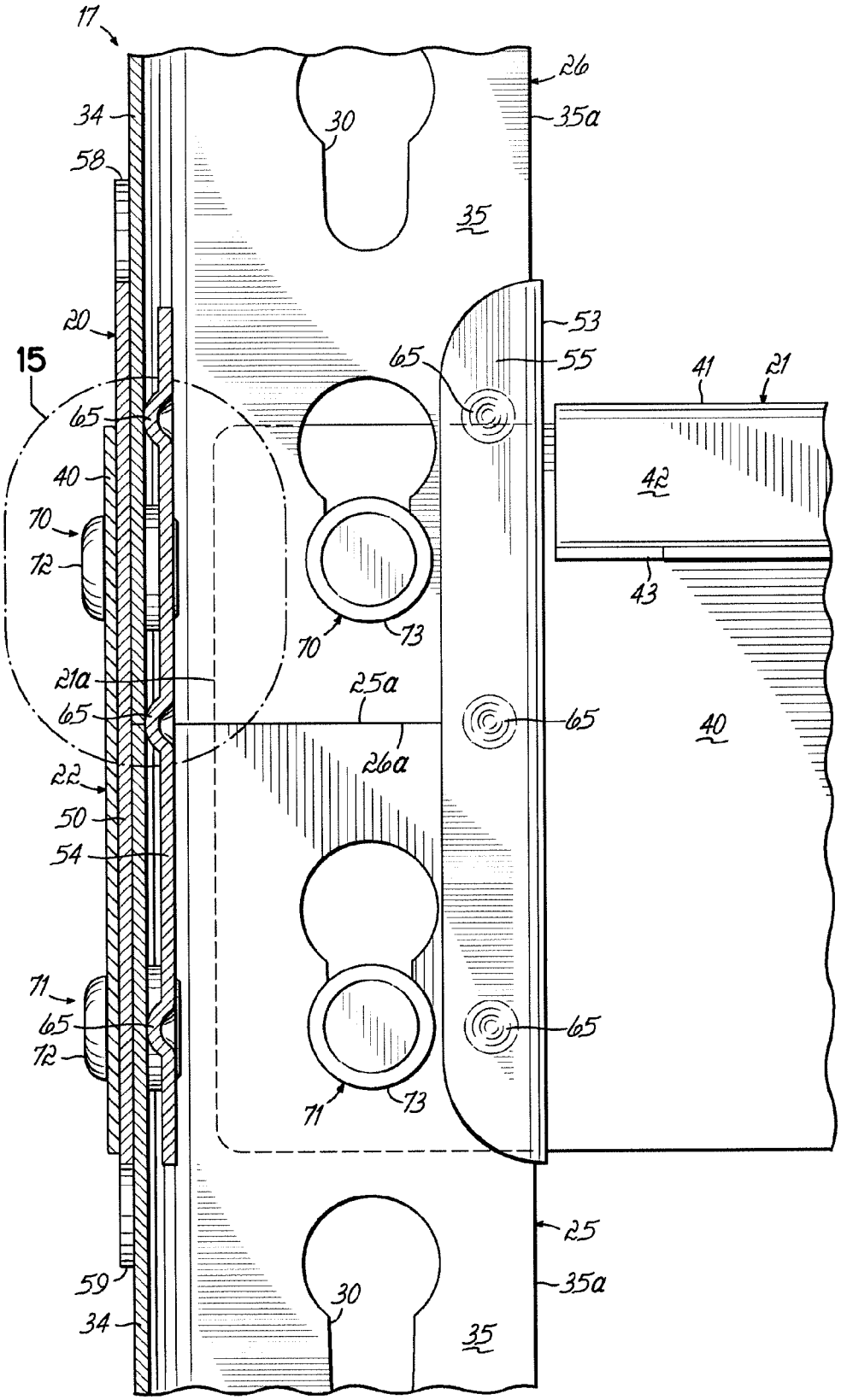

In this embodiment, upper and lower rivets 70, 71 are somewhat shorter than rivets 45, 46 of FIGS. 2-8. Rivets 70, 71 have respective exterior and interior heads 72, 73 (FIG. 10). Interior heads 73 pass through enlarged apertures 60-63 respectively of coupler 20 and post sections 25, 26 respectively, resting on the portions of posts 25, 26 surrounding the narrower portions of apertures 30. Exterior heads engage the webs 40 of the beams 21, 22.

FIGS. 10-15 illustrate in respective cross-section the details of this embodiment. A shelving unit as in this embodiment will have the appearance of unit 10 of FIG. 1, excepting the ends of beams 21, 22 will be positioned outside posts 16-19 and couplers 20.

It will also be appreciated that the invention may include other configurations of the beams 21, 22 suitable with end structures as depicted herein. Other shelf-supporting elements formed in other such beams can be provided to produce shelving units of other configurations, such as where the surfaces of the shelves are disposed below the upper edges of the beams, for example.

Accordingly, this invention contemplates a post coupler 20 in outside wrap form with flanges wrapping around the edges of an angular post from the outside and accommodate shelf-supporting beams disposed at their ends interiorly of the posts or alternately on the outside of the posts, and the couplers accommodating beam supporting rivets without limit to the vertical beam position and shelves supported thereby within the height of the shelf unit corner posts including the areas where composite sections of the post are coupled.

Returning now to FIG. 2A, in conjunction with the post section component in FIGS. 2-5, 7, 9-12 and 15 for example, it will be appreciated that coupler 20 facilitates the assembly of post sections 25, 26 within coupler 20 to form a unitary corner post for the shelving unit 10. In particular, the projections 58, 59 are fully rounded, extending respectively in opposite directions from coupler 20 and more significantly from the corner structure 56 formed at the bend between coupler flanges 50, 51. It will be appreciated that as the flat edge 26*a* of post section 26 and coupler 20 are progressively engaged, the projection 58 easily engages the outside of the corner structure 56 of the post section 26. The post surfaces slide easily along the curved surfaces of the projection 58 serving to smoothly guide and direct the relative movement of the coupler and post section. Thereafter the coupler 20 and post section 26 are conformed together at the lateral edges of the post section 26 easily introduced into the "slot" forming the upper mouth of the gap G.

The reverse bend flanges each terminate short of respective projections 58, 59 and do not obstruct or interfere with the relative initial motion of a post section end 25*a*, 26*a* toward final seating as shown in the figures.

Moreover, it will be appreciated that the projection 58, lying along corner structure 56 of post section 26 strengthens and supports section 26 within the coupler 20.

Of course, the similar construction and combination of projection 59 and post section 25 is likewise described.

As a result, the support provided by coupler 20 to post sections 25, 26 is enhanced, and a more rigid, desirable corner post 16-19 is provided, resulting in a more rigid and stable shelving unit 10.

These and other modifications and variations of the invention will be readily appreciated by the foregoing to those of ordinary skill in the art without departing from the scope of the invention and applicant intends to be bound only by the claims appended hereto.

What is claimed is:

1. A coupler for use in coupling together end-to-end abutting sections of post sections to form a composite post, each said post section including a pair of flanges intersecting at an angle, said coupler comprising:

a pair of coupler flanges also intersecting each other at said angle, and extending longitudinally to proximate respective ends of said coupler, said coupler flanges having respective interior surfaces;

a reverse bend flange extended transversely from an edge of each coupler flange alongside a respective coupler flange and defining a gap with said respective coupler flange;

a rounded projection extending longitudinally from each end of said coupler and from each respective coupler flange, said projection defining a continuously curved end edge of said coupler; and said reverse bend flanges extending longitudinally with each respective coupler flange and having a length shorter than a distance between said projections at each end of said coupler.

2. The coupler as in claim 1 wherein each said projection includes two integral sections, one extending from each coupler flange and intersecting together, at an angle, extending from said angle of intersection of said coupler flanges.

3. The coupler as in claim 1 wherein reverse bend flanges extend alongside interior surfaces of said coupler flanges.

4. A shelving unit having a plurality of corner posts, a plurality of shelf-supporting beams connected to said corner posts and a plurality of shelves supported by said beams, said corner posts each comprising at least two vertically-oriented post sections comprising a pair of flanges intersecting at an angle, coupled together by a post coupler, said post coupler comprising:

a pair of coupler flanges also intersecting each other at said angle, and extending longitudinally to proximate respective ends of said coupler;

a reverse bend flange extended transversely from an edge of each coupler flange alongside a respective coupler flange and defining a gap with said respective coupler flange; a rounded projection extending longitudinally from each end of said coupler and from each respective coupler flange, said projection defining a continuously curved end edge of said coupler; and said reverse bend flanges extending longitudinally with each respective coupler flange and having a length shorter than a distance between said projections at each end of said coupler.

5. The shelving unit as in claim 4 wherein said reverse bend flanges extend alongside interior surfaces of said coupler flanges.

* * * * *